US007394005B1

(12) United States Patent
Anderson et al.

(10) Patent No.: US 7,394,005 B1
(45) Date of Patent: Jul. 1, 2008

(54) ANCHOR FOR MUSICAL INSTRUMENT STRINGS AND METHOD FOR INSTALLING THE ANCHOR

(76) Inventors: Richard Anderson, 1218 N. 35th St., Renton, WA (US) 98056; Dean Wattles, 403 17th St. NW., Poyallup, WA (US) 98371

( * ) Notice: Subject to any disclaimer, the term of this patent is extended or adjusted under 35 U.S.C. 154(b) by 0 days.

(21) Appl. No.: 11/742,360

(22) Filed: Apr. 30, 2007

(51) Int. Cl.
*G10D 3/00* (2006.01)

(52) U.S. Cl. ..... 84/297 R

(58) Field of Classification Search ..... 84/297 R, 84/290, 297 S, 327, 329
See application file for complete search history.

(56) References Cited

U.S. PATENT DOCUMENTS 4,829,871 A * 5/1989 Manson ..... 84/297 S
5,140,884 A * 8/1992 Bowden ..... 84/312 R
5,260,504 A * 11/1993 Turner ..... 84/297 R

* cited by examiner

*Primary Examiner*—Kimberly R Lockett
(74) *Attorney, Agent, or Firm*—David L. Tingey

(57) ABSTRACT

A string or cable anchor useful for anchoring the string to a structure, and advantageously a guitar and other stringed musical instruments, typically has a cylindrical body and alternatively a frustum body with an axial bore therethrough ending in intersection with a second bore at an acute angle. The second bore is directed downward from the axial bore and opens at a body side, the body having a body slot extending partially along the body side through the body and through the acute angle from the body side to a body axis and the axial bore. The body slot larger than the cable diameter and smaller than the string enlarged end and the axial bore larger than the string enlarged end is adapted to receive the string enlarged end into the axial bore at an anchor body top and through the axial bore to the intersection with the second bore and then downward through the second bore to outside of the cylindrical body with the string in the body slot such that as the cable is pulled upward through the axial bore, the cable enlarged end larger than the body slot is pulled against the body slot and the anchor body and is thus anchored to the cable anchor.

20 Claims, 8 Drawing Sheets

ANCHOR FOR MUSICAL INSTRUMENT STRINGS AND METHOD FOR INSTALLING THE ANCHOR

BACKGROUND

1. Field of the Invention

This invention relates primarily to an anchor for securing a guitar string to a guitar bridge, however, the anchor can just as well be employed to other musical instruments and even to other applications beyond musical instruments, such as anchoring a cable on a vehicle bridge and more generally to any application that requires a cable with an enlarged, or ball end, including a wire rope, to be secured under tension.

2. Prior Art

Quality of sound from a guitar is enhanced through the construction of the guitar body, or guitar box, with an internal cavity in which acoustical waves resonate. Similar guitar strings mounted to different guitars will produce a different sound because of the construction of the guitar body. Curvatures and woods employed in the body will produce a different resonance. Primarily, acoustical vibrations are transferred from a vibrating string through the guitar sound hole. However, a significant contribution is obtained in the transfer of vibrations from the string directly to the guitar body through the mount of the string body end to the body through a guitar bridge and bridge plate, which are permanently mounted rearward of the guitar sound hole in normal guitar construction sandwiching a portion of the guitar body between them. It follows that the bridge may be used not only to secure the string body end on one side of the guitar sound hole but also to serve as a conduit of string vibration energy from the string to the guitar top. Thus, to optimize transfer of vibration energy through the bridge and bridge plate it is required that the connection be as solid as possible. A less solid connection will dissipate string vibration energy without optimum conduction to the guitar top.

It is thus advantageous to provide a best connection between the string and the guitar top. This is obtained by securing the string firmly against the bridge and bridge plate, which are mounted to the guitar top. It has been found that a solid connection to the bridge results in a more sustained tone from the guitar longer than a traditional mount of the string to the bridge. A solid connection also yields a more full tone during play because in addition to string vibration energy being transferred into the guitar body cavity from the guitar body top, vibrations of the string or strings is also transferred directly to the guitar body through the string mount. This has been found to be most advantageous for a steel string instrument.

The common means of mounting a string to a guitar at the guitar bridge is by use of a tapered pin in a guitar bridge hole. The pin is typically made of plastic, bone or wood and is a poor conductor of acoustical waves. The pin has a shallow slot along its side in which the string fits. When installed, the string is inserted into the guitar bridge hole, followed by the pin with the string inside the pin slot. The guitar string is then pulled until an enlargement at the string end, typically a ball or some other equivalent, is pulled up against a bridge plate and the pin. The pin is then pushed down securely into the bridge hole and the string is tightened at its other end as necessary to achieve a desired musical pitch when made to vibrate in the normal manner of playing the guitar.

To replace the string, which is necessary when it breaks and also when the string ages and loses its tone, the pin is removed by pulling it out of the bridge plate hole. Repeated removal and installation of the pin can damage the pin and more commonly will damage the guitar bridge hole. When the guitar bridge hole is damaged, it must be repaired. Typically, this requires redrilling the hole to an enlarged size and replacing the pin with a larger pin. A better method would be to provide an anchor that does not require removal and reinstallation during string replacement and achieves a more solid connection between the string and the guitar bridge to conduct string acoustical wave energy to the guitar bridge and hence to the guitar body.

SUMMARY OF THE INVENTION

Tapered pins have been found to be effective in securing a string with a ball on its end to a guitar bridge. The string fits in a vertical groove forward in the pin. The string is placed in the bridge hole followed by the pin loosely slipped in the whole alongside the string with the string fit into the pin groove. The string is then pulled up until the string ball is tight against the bridge plate and the pin is pushed into frictional engagement with the bridge hole. The ball against the bridge plate is reasonably effective in transferring string vibrational energy to the bridge plate and therefore to the guitar top. However, the pull of the ball against the bridge plate though firm has only limited contact with the bridge plate. And with poor acoustical transfer of vibration energy though the plastic pin, effectively the only transfer of energy to the guitar body by conduction is through the ball contact with the bridge plate, which is a small area.

An improved mounting of a guitar string to a guitar is obtained with the cable anchor of the present invention. As stated, with repeated removal of a tapered pin from a bridge hole, the bridge hole suffers wear. As a result, the tapered pinbegins to pop out of the bridge hole under pull from a tensioned string. Without repeated removal of a bridge pin there is no wear on the bridge or bridge pin. The anchor that does not require removal to change a string, which also enables a faster change of a string. No part is removed as the string is easily released from the anchor simply by giving slack to the string and unhooking its enlarged end from the anchor and then pulling the unhooked string through a hole in the anchor. For bridges that have suffered wear a normal repair will typically require about an hour or more to repair the bridge for continued use with a tapered pin. However, repair using the cable anchor of the present invention requires only a quick redrill of the bridge hole and screwing the anchor into the hole, a matter of only a few minutes for all six holes.

An alternate connection to the bridge is by press fitting the anchor from the bottom of the bridge and bridge plate in which case the anchor is preferably flanged at its bottom to facilitate an insertion force. The bridge hole may be right cylindrical in which case the anchor is press fit from the bottom and held in the bridge by the press fit. The whole may also be drilled in a frustum shape with its large end below its smaller end. An anchor of the same shape is then press fit from the bottom into the hole. To optimize contact surface area for the conical anchor, vertical splines are provided on anchor sides. Although the threaded anchor will provide a larger surface area in contact with the bridge and bridge plate and therefore better serve to transfer vibration energy to the body, the press fit anchor remains a viable alternative.

Employing the anchor achieves a same contact of the ball with the bridge plate and also, with the ball in firm contact with the anchor pulled into the corner formed between the bridge plate and the anchor, acoustical energy is effectively conducted through the metal anchor to the bridge plate all along the anchor portion in contact with the bridge throughout the bridge hole. Thus, at least as much energy is transferred to the anchor as to the bridge plate directly from the ball, at least doubling the transfer of energy to the bridge plate. Advantageously, the acoustical energy conducted through the anchor is conveyed throughout the anchor to the bridge plate, top and bridge, not only to the bridge plate. That is, there is a larger guitar surface receiving the acoustical energy through the anchor than just through the small contact between the ball and the bridge plate. Only minimal energy is lost.

In an alternate embodiment, the string enlargement is pulled against the end of the anchor body and effectively all of the acoustical wave energy is transferred to the anchor through its end and then through the anchor body to the guitar bridge.

The anchor simplistically comprises in a first embodiment a threaded body with an axial bore partially therethrough with an open top end and a closed bottom end. The axial bore open at the top end ends intermediate the body in intersection with a second bore at an acute angle to the body axis, directed downward from the axial bore and opening at a body side. In operation, the enlarged end of a string, typically a short cylinder wrapped by the string at the string end, inserts first through the axial bore and then downward through the second bore to outside the anchor body. The string enlarged end is then moved along the body as the string passes through a slit in the body between outside the body and the body axis through the acute angle. In the first embodiment, the enlarged end is pulled upward along the body to engagement with the top and bridge plate at their intersection. In the alternate embodiment, the enlarged end is moved downward along the body also as the string passes through a slit in the body between outside the body and the body axis through the acute angle to rest under the body bottom. When the string is tightened, in both cases the enlarged end is pulled against the anchor into firm contact with it.

The anchor is typically installed with the enlarged end forward, that is toward the guitar sound hole. However, some luthiers prefer that the string be installed with the enlarged end rearward on the bridge, claiming a more solid connection to the bridge and therefore a better transfer of string vibration from the string to the bridge. Either installation is facile, either option obtained by simply turning the anchor in the bridge hole in either preferred direction. The ball will engage the bridge plate either forward or rearward in accordance with the location of the anchor slot.

Installing a threaded anchor employs a screw driver engaging slots in the top of the anchor. Screw drivers are renown for slipping out of slot of a screw head. In this case, there is concern that a screw driver may slip out of slots across the anchor hole and damage the guitar body. Therefore, a specialized tool has been devised. A new tool may be cast or a screw driver may be modified to more firmly engage the anchor to prevent it from inadvertently slipping out of the anchor slots. Notches are cut in both sides the flat screw driver head producing a first flat on the tool end and a larger second flat adjacent the first flat. The first flat width is sized to just fit in the anchor hole, extending sufficiently to prevent inadvertent slipping from the hole. The second flat fits in the anchor slots. Preferably the second flat extends only to the width of the anchor to prevent damage to the guitar body as the anchor is mounted flush with the guitar body. Thus, a second notch in the tool adjacent and above the second flat, with the first flat below the second flat, may be included to limit the width of the second flat. When a new tool is cast, the first portion (equivalent to the first flat for a modified screw driver) may be a more effective shape, such as a cylindrical first portion matching the axial bore in the anchor, which more effectively prevents inadvertent slippage of the tool out of the anchor.

Though the invention is described below largely in terms of a guitar for ease of description, the invention is not limited to a guitar but rather the invention should be deemed in its generalized sense to all applications of anchoring a string or cable or wire rope, including other musical instruments and all industrial applications of anchoring a cable, all of which are deemed included in this invention. For all purposes herein, use of the term "string," the term "cable," or the term "wire rope" is deemed to include any of the others.

DETAILED DESCRIPTION OF THE PREFERRED EMBODIMENTS

Figure 1:
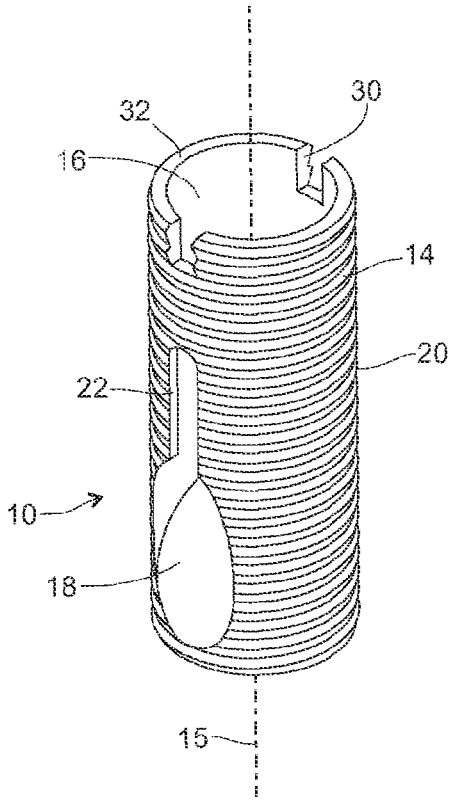
FIG. 1 is a perspective view showing the first embodiment of the string anchor of the present invention, having a closed bottom and a slot upward from a second bore along the anchor body side.
Figure 2:
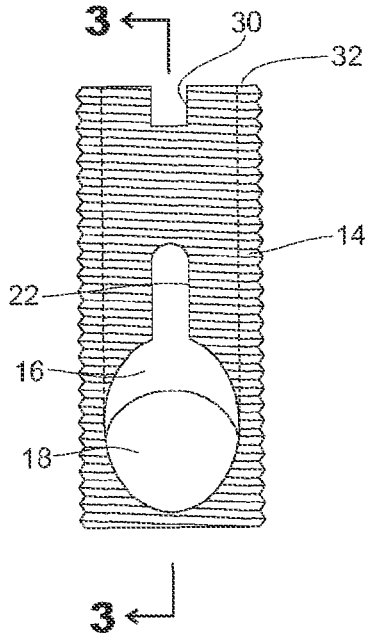
FIG. 2. side view of the string anchor of FIG. 1.
Figure 3:
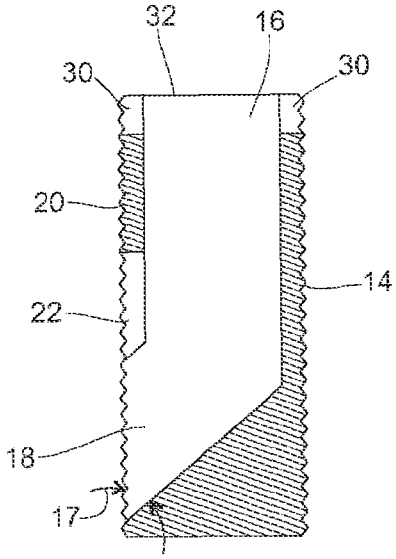
FIG. 3 is a cut-away view of the string anchor of FIG. 1 viewed along the view lines shown in FIG. 2.
Figure 4:
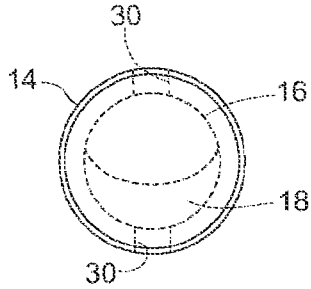
FIG. 4 is a bottom view of the string anchor of FIG. 1.
Figure 5:
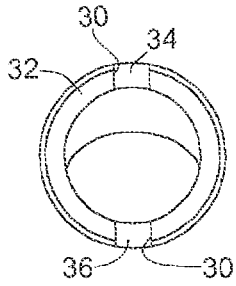
FIG. 5 is a top view of the string anchor of FIG. 1.
Figure 6:
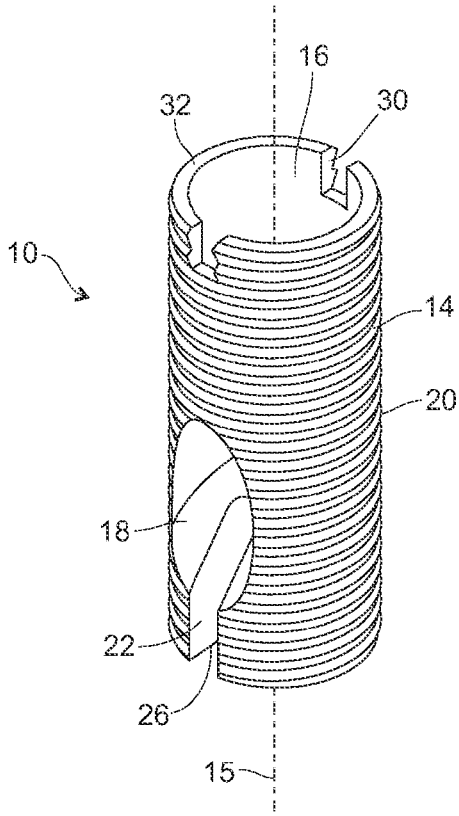
FIG. 6 is a perspective view of an alternate embodiment of the string anchor of the present invention having a slot from outside the anchor body to the body axis and through the bottom to the second bore at an acute angle to the body axis intersecting the axial bore.
Figure 7:
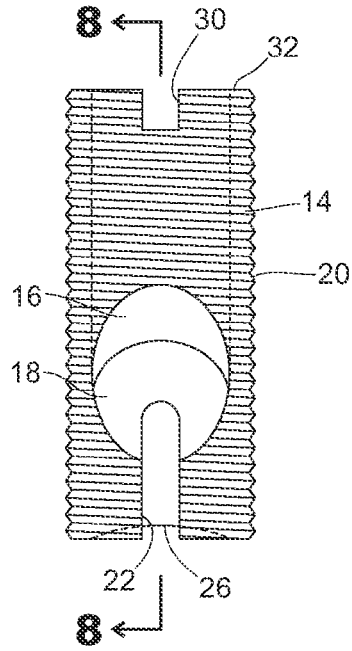
FIG. 7 is a side view of the string anchor of FIG. 6.
Figure 8:
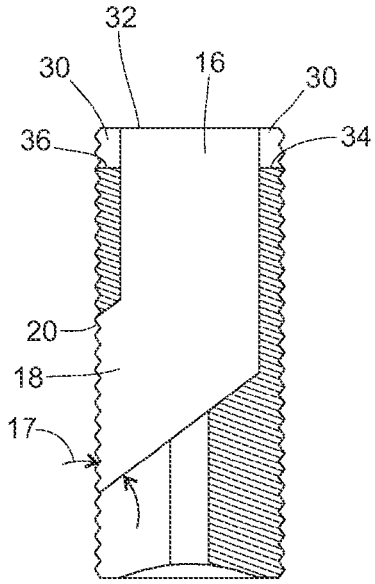
FIG. 8 is a cut-away view of the string anchor of FIG. 6 viewed along the view lines shown in FIG. 7.
Figure 9:
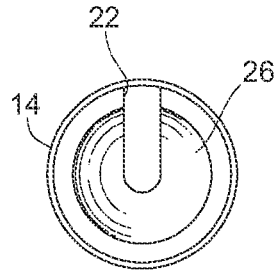
FIG. 9 is a bottom view of the string anchor of FIG. 6.
Figure 10:
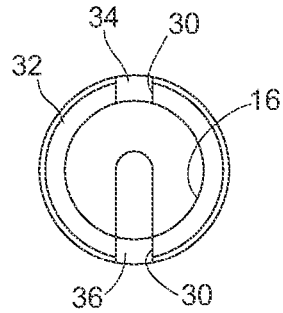
FIG. 10 is a top view of the string anchor of FIG. 6.
Figure 11:
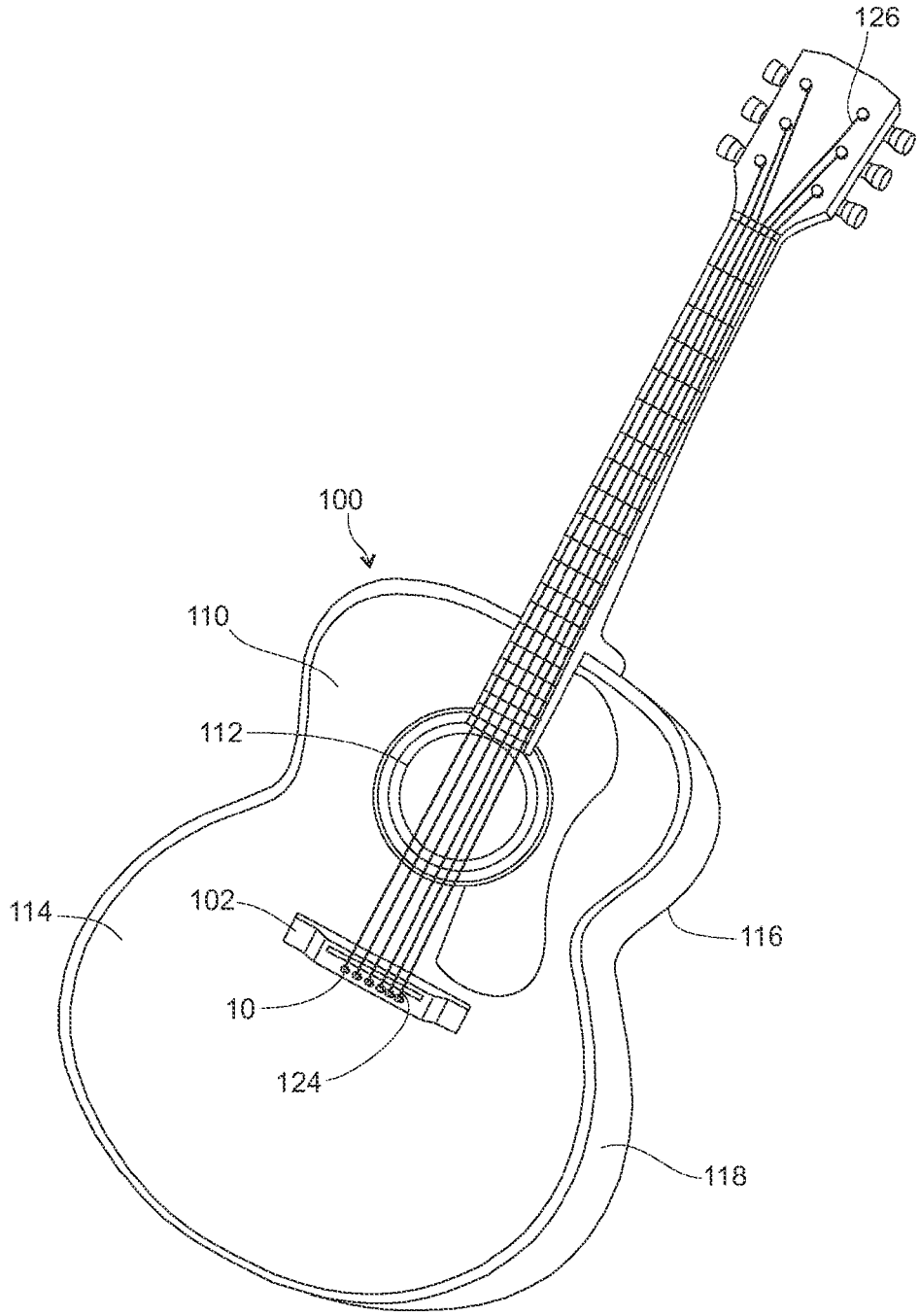
FIG. 11 is a perspective view of a guitar shown with the string anchor of the present invention installed in the guitar bridge.
Figure 12:
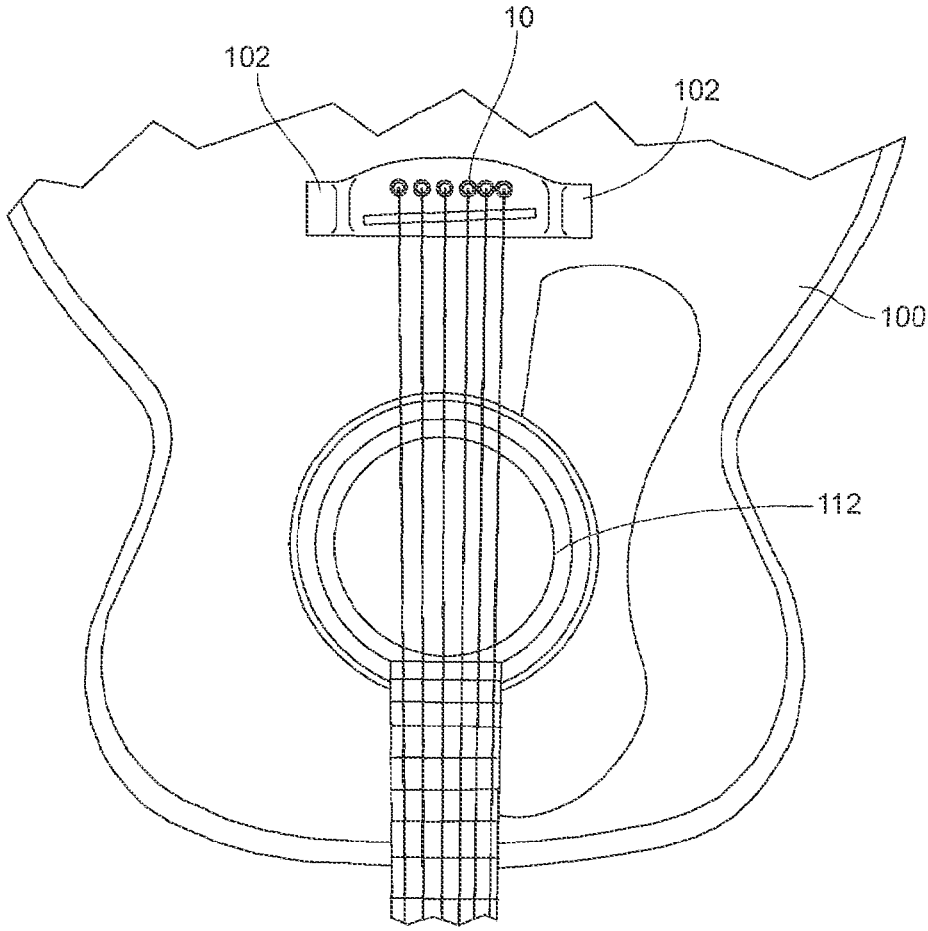
FIG. 12 is a top planar view of the guitar bridge shown in FIG. 11 showing the string anchor of the present invention installed in the guitar bridge.
Figure 13:
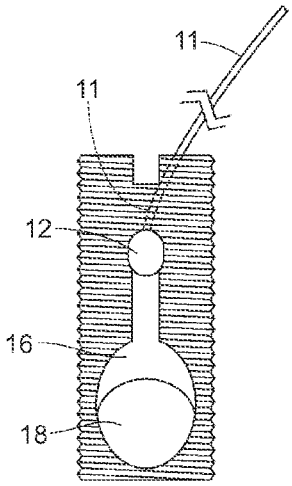
FIG. 13 is a cut-away view of the string anchor of FIG. 1 showing a string installed in the bridge passing through the axial bore of the anchor body with the string enlarged end pulled up outside the anchor body with the string passing through a slot in the body.
Figure 14:
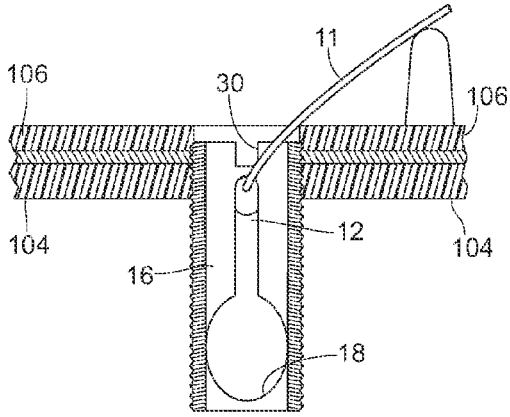
FIG. 14 is a side cross-sectional view of the string anchor installed in the guitar bridge of FIG. 12.
Figure 15:
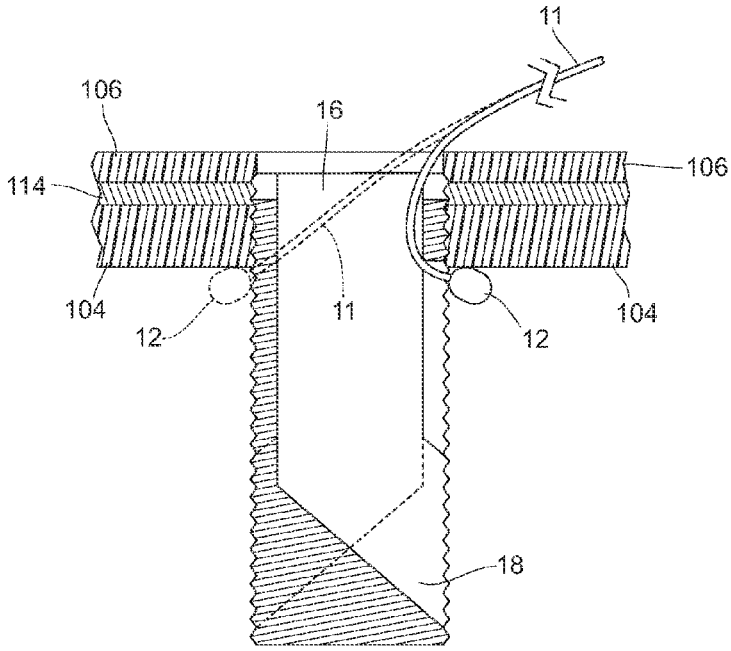
FIG. 15 is a front cross-sectional view of the string anchor installed in the guitar bridge of FIG. 12, with the string enlarged view shown toward the guitar sound hole in solid lines and rearward from the guitar sound hole in dotted lines.
Figure 16:
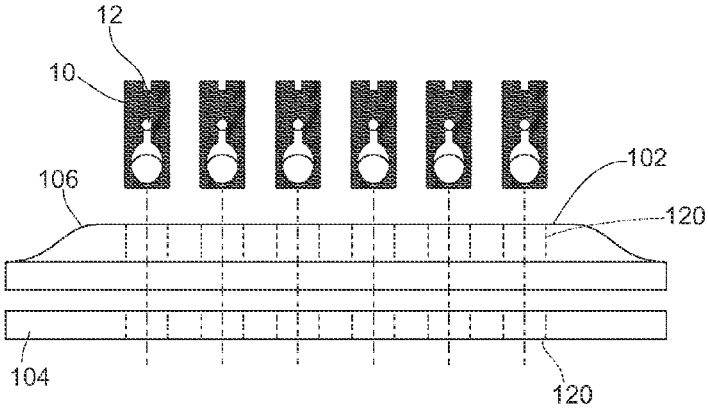
FIG. 16 is a front view of a bridge with its bridge plate aligned as both are attached to a guitar top with the cylindrical string anchor of the present invention aligned to be threaded into their respective holes.
Figure 17:
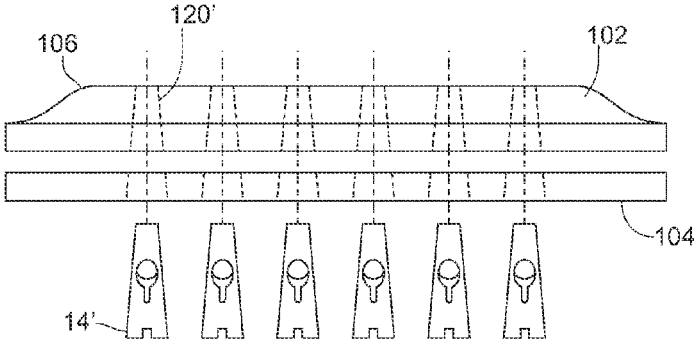
FIG. 17 is a front view of a bridge with a bridge plate aligned as both are attached to a guitar box with a frustum shape string anchor of the present invention, typically at 8-10 degrees taper, in an alternate embodiment aligned to be pressed into their respective holes.
Figure 18:
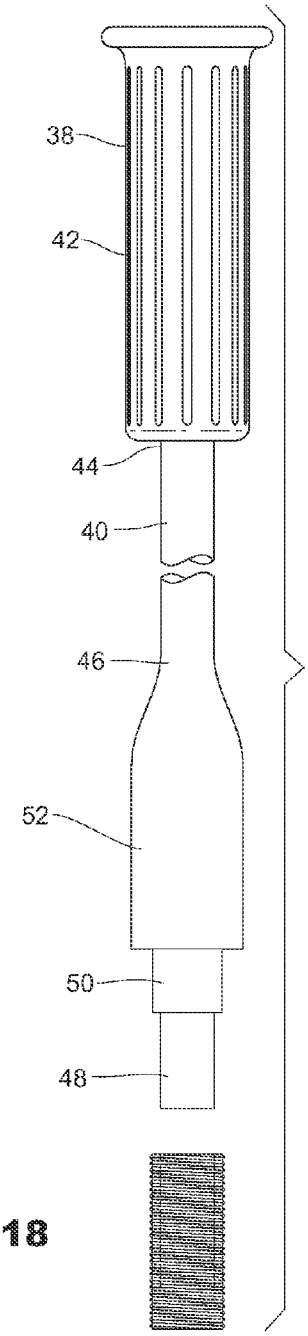
FIG. 18 is a tool for mounting two sizes of a threaded cylindrical string anchor of the present invention, shown aligned with the string anchor.
Figure 19:
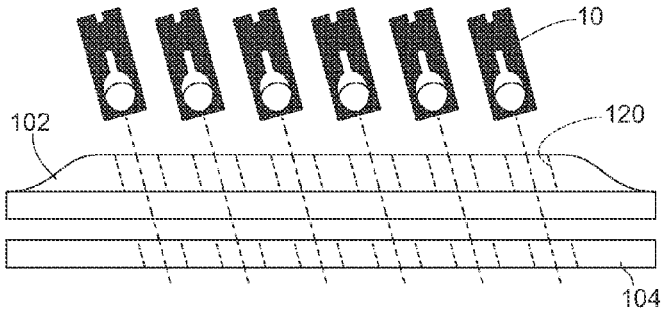
FIG. 19 is a front view of a bridge with its bridge plate as configured in mounting to a guitar with the bridge hole non-orthogonal to the bridge, also showing the string anchor aligned to be threaded into the bridge hole.
Figure 20:
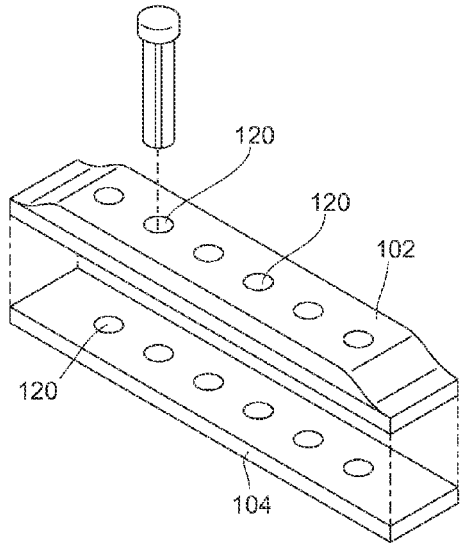
Fig. 20 PRIOR ART
FIG. 20 is a perspective view of the bridge with its aligned bridge plate and a pin of the prior art aligned with the bridge for insertion into a bridge hole.
Figure 21:
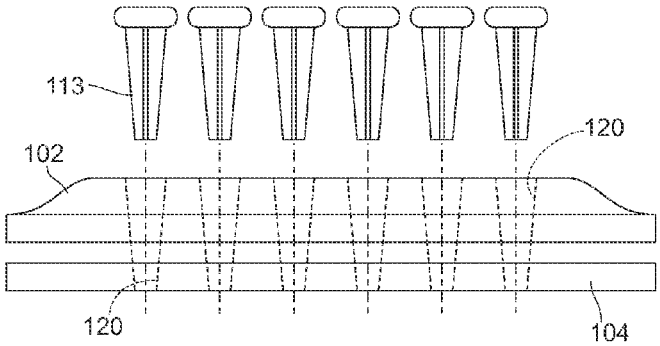
Fig. 21 PRIOR ART
FIG. 21 is a front view of the bridge, bridge plate, and pin of FIG. 19.
Figure 22:
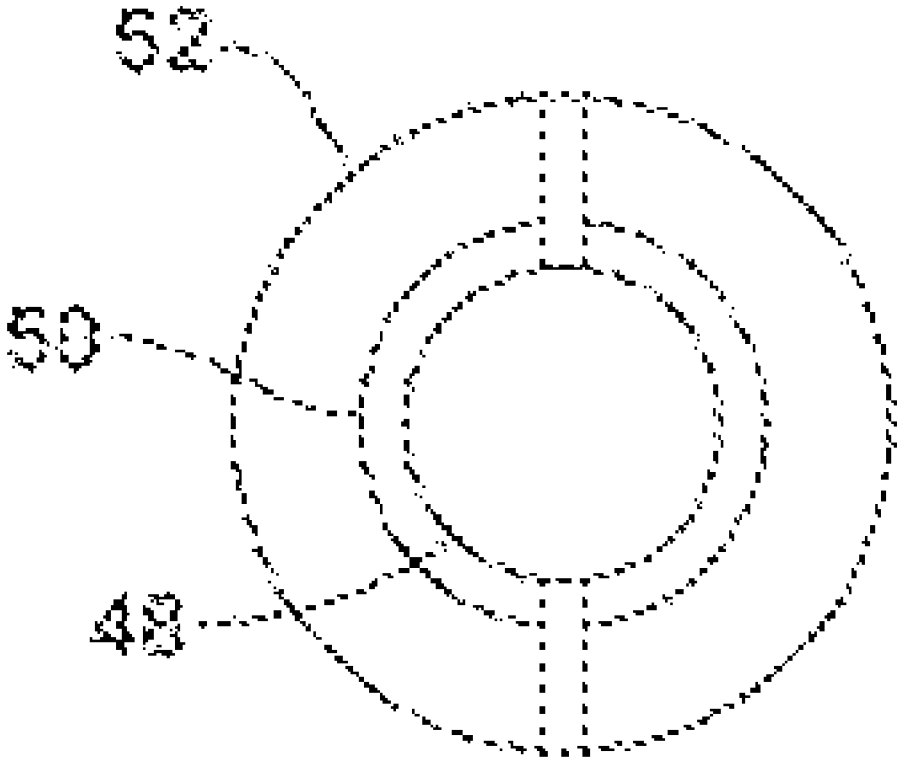
FIG. 22 is an end view of the tool of FIG. 18.

The string anchor 10 of the present invention is for connecting a string 11 (equivalently, a cable) that has a string diameter with a string enlarged end 12 to another structure, for ease of description, herein described as a guitar 100 with a guitar bridge 102 into which the string anchor 10 mounts.

It is well known to have a guitar 100 with a guitar body, or an acoustical box 110, including a box top 114 and bottom 116 separated by box sides 118 with the bridge plate 104 and bridge top 106 sandwiching the box top 114 between them with the bridge plate 104 within the box 110. Guitar strings typically have a string diameter and said enlarged end, or enlargement 12 at a first end and are anchored non-adjustably at a first string end to the guitar 100 at a first, or bridge, position 124 and secured to the guitar 100 under adjustable tension at a string second end at a guitar second position 126 spaced apart from the first position.

The string anchor 10 comprises a cylindrical body 14 that has an axial bore 16 therethrough ending in intersection with a second bore 18 that intersects the axial bore 16 at an acute angle 17. The second bore 18 is directed downward from the axial bore 16 and opens at a body side 20. The body 14 has a body slot 22 extending partially along the body side 20 and through the cylindrical body 14 and through the acute angle 17 from the body side 20 to the axial bore 16. The body slot 22 is larger than the string diameter and smaller than the string enlarged end 12 and the axial bore 16 is larger than the string enlarged end 12. The anchor 10 is adapted to receive the string enlarged end 12 slidably into the axial bore 16 at an open anchor body top 32 and through the axial bore 16 to the intersection with the second bore 18 and then downward through the second bore 18 to outside of the cylindrical body 14. As the string 11 is pulled upward through the axial bore 16, the string enlarged head end smaller than the body slot 22 is pulled against the anchor body 14 and is thus anchored to the string anchor 10.

In the preferred embodiment, the body slot 22 extends upward from the second bore 18 partially along the body side 20 and through the cylindrical body 14 from the body side 20 to the axial bore 16 to receive the string 11 passing through the body slot 22 such that as the string 11 pulled through the body slot 22 and upward through the axial bore 16, the string enlarged end 12 larger than the body slot 22 is pulled against the anchor body side 20 and is thus anchored to the string anchor 10. In an alternate embodiment, the body slot 22 extends downward from the second bore 18 partially along the body side 20 and through the cylindrical body 14 from the body side 20 to the axial bore 16, to below the bottom 26 of the anchor body 14 with the string 11 passing through the body slot 22 such that as the string 11 is pulled upward through the axial bore 16, the string enlarged end smaller than the body slot 22 is pulled up against the anchor body bottom 26 and is thus anchored to the string anchor 10.

In the preferred embodiment the string anchor 10 comprises a threaded right cylindrical body 14, with an axis 15, that is threaded into a hole in the guitar bridge 102. In an alternate embodiment, the anchor also may not be threaded and but press fit into the hole. The anchor may include vertical splines 28 outside along the body to facilitate improved wave energy communication from the string anchor 10 into the guitar bridge 102. In a further alternate embodiment, the string anchor 10 comprises a frustum body 14' with an upper end smaller than a bottom end, with the upper end pressed into the guitar bridge 102 above the lower end through the guitar bridge plate 104 in the guitar top 114.

To facilitate threading of the string anchor 10, the cylindrical body 14 has a top slot 30 horizontal diametrically across the body top 32 and the axial bore 16 which axial bore 16 divides the top slot into first and second slot portions adapted to receive a turning tool 38 that threads the body 14 into the bridge 102. The turning tool 38 comprises a shank 40 with a handle 42 on a first end 44 and on a shank second end 46 a lower portion 48 adapted to releasably fit into the axial bore 16 of the anchor body 14. The lower portion 48 may be a slot or preferably may be cylindrical matching the anchor body axial bore 16. A flat 50 adjacent the lower portion 48 is adapted to fit into the first and second slot portions 34, 36 of the top slot 30. The flat 50 when inserted into the first and second portions 34, 36 typically does not extend beyond the cylindrical body circumference so as not to contact and damage the bridge 102 when the string anchor 10 is inserted into the bridge 102. A flat upper portion 52 on the tool shank 40 adjacent the flat 50 also extends radially outward from the tool shank beyond the flat 50 to fit into fist and second slot portions larger anchor (not shown) such as may be employed with a base, making the tool useful for both sizes.

The string anchor 10 is particularly advantageous to a guitar 100 and other stringed musical instruments because the strings can be made to vibrate with improved conduction of string vibrational wave energy with associated musical tones to the guitar body, or box 110, not only through the guitar box hole 112 but also through the anchor 10 to the guitar bridge 102. To exploit high conductivity of mechanical, or acoustical wave energy through metal, the string anchor 10 is preferably made of metal but it may be made of some other material having a high conductivity of acoustical wave energy, rather than a plastic, bone, or wood pin 113 of the prior art.

Thus, employing the anchor of the present invention, the anchor 10 extends through the bridge 102 and into the guitar box 110 such that the anchor second bore 18 opens into the box 110 and the body slot 22 extends at least partially into the box 110 at the bridge plate 104 such that as the string 11 under tension is pulled firmly against the body side 20 and the bridge 102, the vibrations of the string 11 being conducted in part to the bridge plate 104 and the box 110 causing the box 110 to vibrate from the vibrations of the string 11. Preferably, the anchor 10 is mounted orthogonal to the bridge plate 104. In a further alternate embodiment, the anchor 10 is in the bridge 102 non-orthogonal to the box 114 top to increase anchor 10 surface area in contact with the bridge plate 104 for enhanced conduction of the string vibrational energy to the bridge 102.

In practice then, a musical string 11 is installed in a guitar bridge 102 by first securing the string anchor 10 into the bridge hole 108 that extends through the guitar bridge 102, the string anchor 10 extending into the guitar top 114 with the second bore 18 opening into the guitar box 110. It is often necessary to redrill the bridge hole 120 in the guitar bridge 102, especially if the hole has been damaged, even enlarging the existing bridge hole 120.

When a string anchor 10 of frustum shape is employed, a bridge hole 120' is drilled also in matching frustum shape and the string anchor 10 is press fit into the bridge hole 120' from inside the guitar box 110 with its small end upward and its larger end downward into the guitar box 110.

The string enlarged end 12 is then slid from outside the guitar 100 though the axial bore 16 and the second bore 18 and into the guitar box 110. The string enlarged end 12 is then moved to along the body 14 with the string 11 inserting into the body slot 22. The string 11 is then pulled through the axial bore 16 such that as the string 11 is pulled the string enlarged end 12 which is larger than the body slot 22 is pulled tight against the anchor body 14 and is thus anchored to the string anchor.

Having described the invention, what is claimed is as follows:

1. A cable anchor for connecting a cable having a cable diameter with an enlarged end, comprising a cylindrical body with a top and a bottom and having an axial bore therethrough ending in intersection with a second bore at an acute angle, the second bore being directed downward from the axial bore and opening at a body side, the body having a body slot extending partially along the body side and through the cylindrical body through the acute angle from the body side to a body axis, the body slot being larger than the cable diameter and smaller than the enlarged end and the axial bore being larger than the enlarged end adapted to receive the cable enlarged end into the axial bore at an anchor body top and through the axial bore to the intersection with the second bore and then downward through the second bore to outside of the cylindrical body with the cable inserting in the body slot and the enlarged head end moving along the slot outside the body such that when the cable is pulled upward through the axial bore, the cable enlarged end which is larger than the body slot is pulled against the body slot and the anchor body and is thus anchored to the cable anchor.

2. The cable anchor of claim 1 comprising a right cylindrical anchor body.

3. The cable anchor of claim 1 comprising a frustum shaped body with an upper end smaller than a bottom end.

4. The cable anchor of claim 1 wherein the cylindrical body comprises threads adapted to thread the cable anchor into a structure to which the cable is to be anchored.

5. The cable anchor of claim 4 wherein the cylindrical body further comprises a top slot horizontal and diametrically across the anchor body top and the axial bore which divides the top slot into first and second slot portions, being adapted to receive a turning tool that threads the body into the member.

6. The cable anchor of claim 5 wherein said turning tool comprises a shank with a handle on a first end, on a shank second end a lower portion adapted to releasably fit into the axial bore of the anchor body, a flat adjacent the lower portion adapted to releasably fit into said first and second slot portions of the top slot.

7. The cable anchor of claim 6 wherein the flat when inserted into the first and second portions does not extend beyond the cylindrical body circumference so as not to contact the member when the cable anchor is inserted into the member.

8. The cable anchor of claim 7 further comprising a flat upper portion on the tool shank extending radially outward from the tool shank beyond the flat adjacent the flat, adapted to releasably fit into larger first and second slot portions of a larger top slot.

9. The cable anchor of claim 1 further comprising vertical splines outside along the body.

10. The cable anchor of claim 1 wherein said body slot extends upward from the second bore partially along the body side and through the cylindrical body from the body side to the axial bore to receive the cable passing through the body slot such that when the cable is pulled through the body slot and upward through the axial bore, the cable enlarged head end being larger than the body slot is pulled against the body slot and the anchor body side and is thus anchored to the cable anchor.

11. The cable anchor of claim 1 wherein said body slot extends downward from the second bore partially along the body side and through the cylindrical body from the body side to the body axis to below the bottom of the anchor body and with the cable passing through the body slot with the cable enlarged end under the body bottom such that as the cable is pulled upward through the axial bore, the cable enlarged head end being larger than the body slot is pulled up against the anchor body bottom and is thus anchored to the cable anchor.

12. A musical instrument with strings adapted to vibrate to produce musical tones, said strings having a string diameter and an enlargement at its first end and being anchored non-adjustably at said string first end to the musical instrument at a musical instrument first position and secured under adjustable tension at a musical instrument second end at a musical instrument second position spaced apart from said first position, the improvement comprising a string anchor with a bottom and a top at the musical instrument first position including a cylindrical body having an axis and an axial bore therethrough ending in intersection with a second bore at an acute angle, the second bore being directed downward from the axial bore and opening at a body side, the body having a body slot extending partially along the body side and through the acute angle to the axis, the body slot being larger than the string diameter and smaller than the string enlargement and the axial bore being larger than the string enlargement, adapted to receive the string enlargement into the axial bore at the anchor body top and through the axial bore to the intersection with the second bore and then downward through the second bore to outside of the cylindrical body with the string through the body slot such that as the string is pulled upward through the axial bore, the string enlargement larger than the body slot is pulled against body slot and the anchor body and is thus anchored to the string anchor and adapted to sustain tensioning of the string at the musical instrument second position.

13. The musical instrument of claim 12 wherein the anchor is in a bridge at the musical instrument first position, the bridge comprising a bridge plate and a bridge top, the musical instrument comprising an acoustical box including a box top and bottom separated by box sides with the bridge plate and bridge top sandwiching the bridge top between them with the bridge plate within the box, the anchor extending through the bridge and into the bridge box such that the anchor second bore opens into the box and the body slot extends at least partially into the box such that when the string under tension is pulled firmly against the anchor body and the bridge, the vibrations of the string are conducted in part to the bridge plate and the box causing the box to vibrate from the vibrations of the string.

14. The musical instrument of claim 13 wherein the anchor is of a material having a high conductivity of acoustical vibrations such that vibrations of the string are conducted to the box.

15. The musical instrument of claim 13 wherein the anchor is in the bridge non-orthogonal to the box top.

16. The method of installing a musical string in a guitar bridge of a guitar having a guitar box, said strings having a string diameter and an enlargement at a string first end and employing a string anchor having a cylindrical body with an axis and an axial bore therethrough ending in intersection with a second bore at an acute angle, the second bore being directed downward from the axial bore and opening at a body side, the body having a body slot extending partially along the body side and through the acute angle to the body axis, the body slot being larger than the string diameter and smaller than the string enlarged end enlargement and the axial bore being larger than the string enlarged end enlargement, adapted to receive the string enlargement into the axial bore at an anchor body top and through the axial bore to the intersection with the second bore and then downward through the second bore to outside of the cylindrical body, comprising the following steps:

a. securing the string anchor into a hole extending through the guitar bridge, the string anchor extending into the guitar box with the second bore opening into the guitar box;

b. sliding the string enlargement from outside the guitar though the axial bore and the second bore and into the guitar box with the string in the body slot;

c. moving the string enlargement to the secure position;

d. pulling the string upward through the axial bore such that as the string is pulled the string enlargement being larger than the body slot is pulled tight against the body slot and the anchor body and is thus anchored to the string anchor.

17. The method of claim 16 further comprising the step of drilling said hole in the guitar bridge.

18. The method of claim 16 further comprising the step of enlarging an existing hole in the guitar bridge.

19. The method of claim 16 further comprising the steps of employing a string anchor having a threaded circumference and threading the string anchor into the hole in the guitar bridge.

20. The method of claim 16 further comprising the steps of a. Enlarging the hole in the guitar bridge into a frustum shape with a small end upward and a larger end downward into the guitar box;

b. Employing a frustum shape string anchor matching the enlarged hole and press fitting the string anchor into the hole.

* * * * *